United States Patent [19]

Watson et al.

[11] Patent Number: 4,481,988

[45] Date of Patent: Nov. 13, 1984

[54] LOG SPLITTER

[75] Inventors: Gary E. Watson; James R. Doornek, both of Mequon, Wis.

[73] Assignee: Douglas Dynamics, Inc., Milwaukee, Wis.

[21] Appl. No.: 551,021

[22] Filed: Nov. 14, 1983

[51] Int. Cl.[3] ..... B27L 7/00

[52] U.S. Cl. ..... 144/193 A; 144/193 R

[58] Field of Search ..... 144/193 R, 193 A, 3 K, 144/366

[56] References Cited

U.S. PATENT DOCUMENTS 4,240,476 12/1980 Rattray ..... 144/193 A

*Primary Examiner*—W. D. Bray

[57] ABSTRACT

A log splitter comprising a frame generally in the shape of a right triangle having three legs lying in a vertical plane. The frame includes an elongated horizontal member forming the first leg of the right triangle, the elongated horizontal member including a first end, a second end, and an upper surface adapted to support a log. The frame also includes an elongated second member forming the hypotenuse of the right triangle and being positioned below the elongated horizontal member, the elongated second member including a first end and a second end. The first end of the elongated second member is fixedly attached to the first end of the elongated horizontal member. The second end of the elongated second member is adapted to rest on a supporting surface. The frame further includes a wedge member including upper and lower portions, the upper portion of the wedge member extending upwardly from the second end of the elongated horizontal member and having a splitting edge, and the lower portion of the wedge member forming the third leg of the right triangle and being secured to the second end of the elongated horizontal member and to the second end of the elongated second member and supporting the second ends in rigidly spaced apart relation. The log splitter also includes means for supporting the first end of the elongated horizontal member and the first end of the elongated second member above the supporting surface and ram means for pushing a log along the upper surface of the elongated horizontal member toward the splitting edge of the wedge member for splitting the log with the wedge member.

24 Claims, 2 Drawing Figures

LOG SPLITTER

BACKGROUND OF THE INVENTION

This invention relates to log splitters, and more particularly to log splitters for use by homeowners.

Many prior art log splitters are unsuitable for use by the average homeowner because they are expensive to purchase and to maintain, and difficult to transport without a tractor or similar vehicle. Prior log splitters are more suitable for commercial or large scale use.

Additionally, many prior art log splitters typically employ an I-beam or a similar structural member as the main frame component. These I-beams are heavy, making the log splitter difficult to transport, and they are expensive.

On prior log splitters, it is also common for the log splitting wedge to be welded to the I-beam or main structural member. This produces at least two negative results. First, replacement of the splitting wedge is expensive and difficult. Second, the force exerted on the wedge by the log during operation imparts a bending moment to the I-beam, resulting in bending of the frame.

Another disadvantage of many prior log splitters is that they typically require means for supporting both ends of the frame of the log splitter.

Attention is directed to the following U.S. patents which disclose log splitters:

| Patentee | Pat. No. | Issued |
|---|---|---|
| Biles | 3,319,675 | 5/16/67 |
| Heikkinen | 3,862,651 | 1/28/75 |
| Williams | 4,019,549 | 4/26/77 |
| Sarno | 4,066,110 | 1/3/78 |
| Kanik | 4,076,062 | 2/28/78 |
| McCallister | 4,141,396 | 2/27/79 |
| King | 4,153,088 | 5/8/79 |
| Hoskin | 4,284,112 | 8/18/81 |

SUMMARY OF THE INVENTION

The present invention provides an improved log splitter having an improved frame construction. One of the principal features of the invention is the provision of a log splitter having a frame generally in the shape of a right triangle, with the lower portion of the wedge member forming the third leg of the triangle. This construction provides strength and prevents bending of the elongated horizontal member, because the elongated second member counteracts the force exerted by the log on the wedge member and the bending moment imparted to the elongated horizontal member. This construction also provides a frame having one end adapted to rest on a supporting surface, thereby removing the need for means supporting that end of the frame.

Another principal feature of the invention is the provision of an elongated horizontal member including a pair of elongated angle members, instead of an I-beam. This makes the log splitter less expensive to build, and also makes the log splitter lighter and more portable.

Another principal feature of the invention is the provision of a wedge member removably secured to the elongated horizontal member and to the elongated second member. This permits the wedge member to be easily replaced.

Another principal feature of the invention is that the elongated angle members of the elongated horizontal member are releasably attached to each other. This makes these components also easy to replace.

Referring to the specific construction of the log splitter embodying the invention, the log splitter includes a frame generally in the shape of a right triangle having three legs lying in a vertical plane, the frame having a longitudinal axis and including an elongated horizontal member forming the first leg of the right triangle. The elongated horizontal member includes a first end, a second end, and an upper surface adapted to support a log. The frame also includes an elongated second member forming the hypotenuse of the right triangle and being positioned below the elongated horizontal member. The elongated second member includes a first end and a second end, the first end of the elongated second member being fixedly attached to the first end of the elongated horizontal member, and the second end of the elongated second member being spaced below the second end of the elongated horizontal member such that the elongated second member and the elongated horizontal member form an acute angle. The second end of the elongated second member is also adapted to rest on a supporting surface. The frame further includes a wedge member including upper and lower portions, the upper portion of the wedge member extending upwardly from the second end of the elongated horizontal member and having a splitting edge, the splitting edge being generally perpendicular to the longitudinal axis of the elongated horizontal member and facing the first end of the elongated horizontal member. The lower portion of the wedge member forms the third leg of the right triangle and is secured to the second end of the elongated horizontal member and to the second end of the elongated second member and supports the second ends in rigidly spaced apart relation. The log splitter further includes means for supporting the first end of the elongated horizontal member and the first end of the elongated second member above the supporting surface, and ram means for pushing a log along the upper surface of the elongated horizontal member toward the splitting edge of the wedge member for splitting the log with the wedge member.

In one embodiment, the elongated horizontal member comprises a pair of elongated members bolted together, the elongated second member comprises a pair of elongated members bolted together, and the lower portion of the wedge member is positioned between and bolted to the elongated members comprising the elongated horizontal member and the elongated second member.

In one embodiment, the wedge member is removably secured to the second ends of the elongated horizontal member and the elongated second member.

The invention also provides a log splitter having a frame including an elongated horizontal member having a longitudinal axis. The elongated horizontal member has first and second ends and includes a pair of elongated parallel angle members, the elongated angle members each including first and second elongated flat portions with the first elongated flat portion having a lateral edge integrally joined to a lateral edge of the second elongated flat portion. The pair of elongated angle members are fixedly attached to and spaced apart from each other such that the first elongated flat portions are spaced apart in back-to-back relation and the second elongated flat portions extend in opposite directions from the back-to-back first elongated flat portions and lie in a common plane. The second elongated flat portions form a generally flat upper surface facing upwardly and being adapted to support a log. The frame also includes an elongated second member positioned below the elongated horizontal member, the elongated second member having first and second ends. The first end of the elongated second member is fixedly connected to the first end of the elongated horizontal member, and the second end of the elongated second member is spaced below the second end of the elongated horizontal member such that the elongated second member and the elongated horizontal member form an acute angle. The second end of the elongated second member is also adapted to rest on a supporting surface. The frame further includes a wedge member extending vertically in the common plane of the elongated horizontal member and the elongated second member, the wedge member including a splitting edge extending upwardly from the elongated horizontal member and generally perpendicular to the longitudinal axis of the elongated horizontal member, the splitting edge facing the first end of the elongated horizontal member. The log splitter further includes means for supporting the first end of the elongated horizontal member and the first end of the elongated second member above the supporting surface, and ram means for pushing a log along the upper surface of the elongated horizontal member toward the splitting wedge for splitting the log with the splitting wedge.

In one embodiment, the elongated second member includes a pair of elongated angle members such as the elongated angle members of the elongated horizontal member, with the second elongated flat portions of the elongated angle members forming a generally flat surface facing generally downward.

In one embodiment, the wedge member includes upper and lower portions, the upper portion of the wedge member extending upwardly from the second end of the elongated horizontal member and including the splitting edge, and the lower portion of the wedge member being secured to the second end of the elongated horizontal member and to the second end of the elongated second member and supporting the second ends in rigidly spaced apart relation.

In one embodiment, the elongated angle members of the elongated horizontal member are releasably attached to each other in spaced apart back-to-back relation.

In one embodiment, the lower portion of the wedge member is removably bolted between the spaced apart first elongated flat portions of the elongated horizontal member and is removably bolted between the spaced apart first elongated flat portions of the elongated second member.

Other features and advantages of the invention will become apparent to those skilled in the art upon reviewing the following detailed description, the drawings, and the claims.

DESCRIPTION OF THE PREFERRED EMBODIMENT

Figure 1:
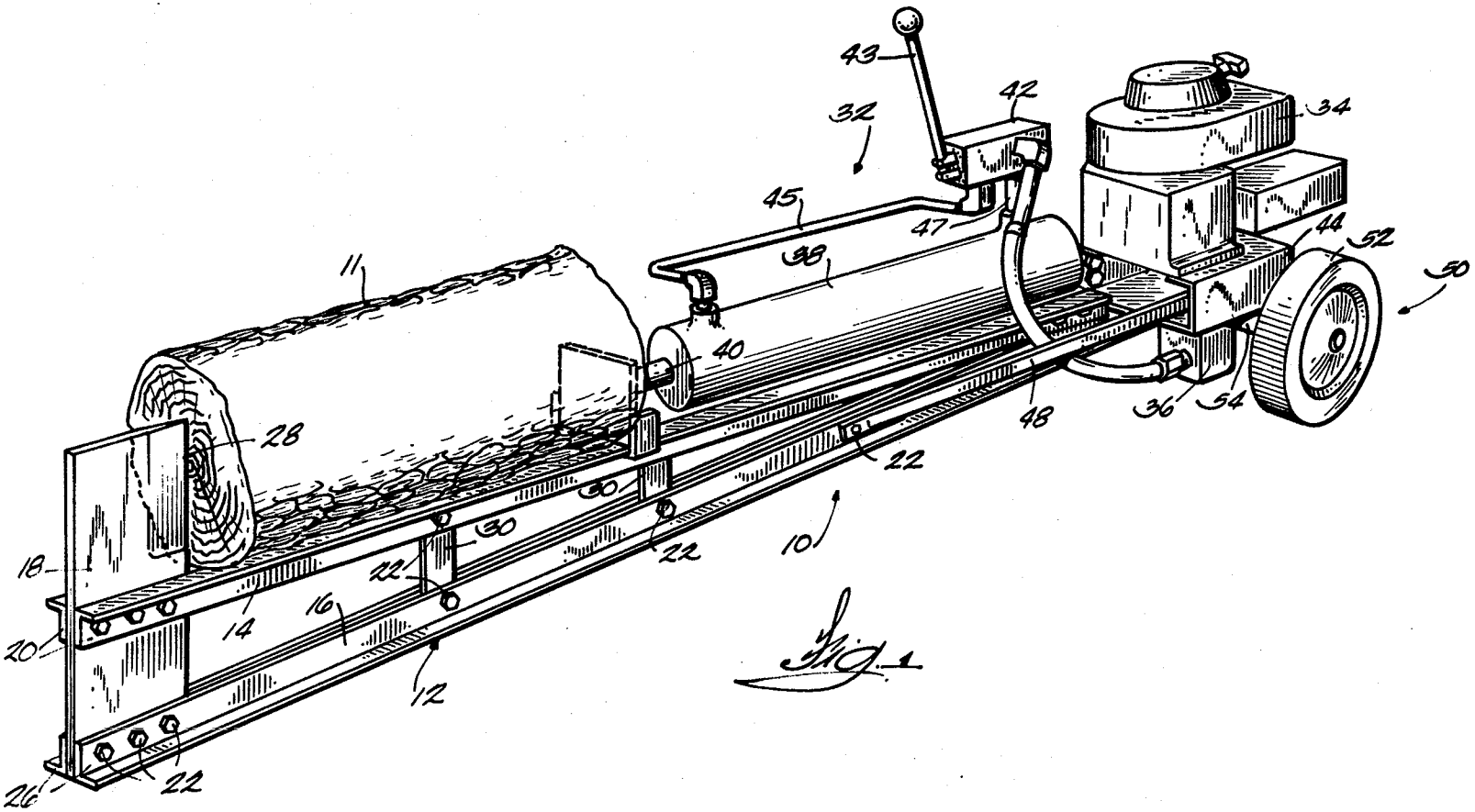
FIG. 1 is a perspective view of the log splitter of the invention, shown with a log in position to be split.

Illustrated in FIG. 1 is a log splitter 10 embodying the invention, and shown with a log 11 in position to be split by the log splitter 10. The log splitter 10 has a frame 12 generally in the shape of a right triangle lying in a vertical plane, the main components of the frame 12 being an elongated horizontal member 14, an elongated second member 16, and a wedge member 18.

The elongated horizontal member 14 has a longitudinal axis and first and second ends, and forms the first leg of the right triangle. The elongated horizontal member 14 is comprised of a pair of elongated angle members 20. In this embodiment, the elongated angle members 20 are elongated angles, although in alternative embodiments the elongated angle members 20 could have other configurations. The elongated angle members 20 are fixedly attached to and apaced apart from each other by bolts 22, in a manner described below. The elongated angle members 20 form a generally flat surface facing upwardly and being adapted to support a log 11 as shown in FIG. 1.

The elongated second member 16 lies in the vertical plane of the elongated horizontal member 14 and is positioned below the elongated horizontal member 14, as shown in FIG. 1. The elongated second member 16 has first and second ends and forms the hypotenuse of the right triangle. The first end of the elongated second member 16 is fixedly attached to the first end of the elongated horizontal member 14 by a backplate 24, the backplate 24 being further described below, such that the elongated horizontal member 14 and the elongated second member 16 form an acute angle as illustrated in FIG. 1.

The elongated second member 16 comprises a pair of elongated angle members 26, similar to the elongated angle members 20 forming the elongated horizontal member 14, as described above. The elongated angle members 26 of the elongated second member 16 are fixedly attached to and spaced apart from each other by bolts 22, in a manner also described below. The generally flat surface formed by the elongated angle members 26 of the elongated second member 16 faces generally downwardly, and the second end of the elongated second member is adapted to rest on the supporting surface.

The wedge member 18 is a plate extending vertically in the common plane of the elongated horizontal member 14 and the elongated second member 16, and having upper and lower portions. The lower portion of the wedge member 18 forms the third leg of the right triangle and is removably secured to the second end of the elongated horizontal member 14 and to the second end of the elongated second member 16 by being removably bolted between the elongated angle members 20 of the elongated horizontal member 14 and the elongated angle members 26 of the elongated second member 16. The upper portion of the wedge member 18 includes a splitting edge 28 generally perpendicular to the longitudinal axis of the elongated horizontal member 14 and facing the first end of the elongated horizontal member 14. In this embodiment, the wedge member 18 is made of heat treated steel, although in alternative embodiments the wedge member 18 could be made of any suitable material.

Figure 2:
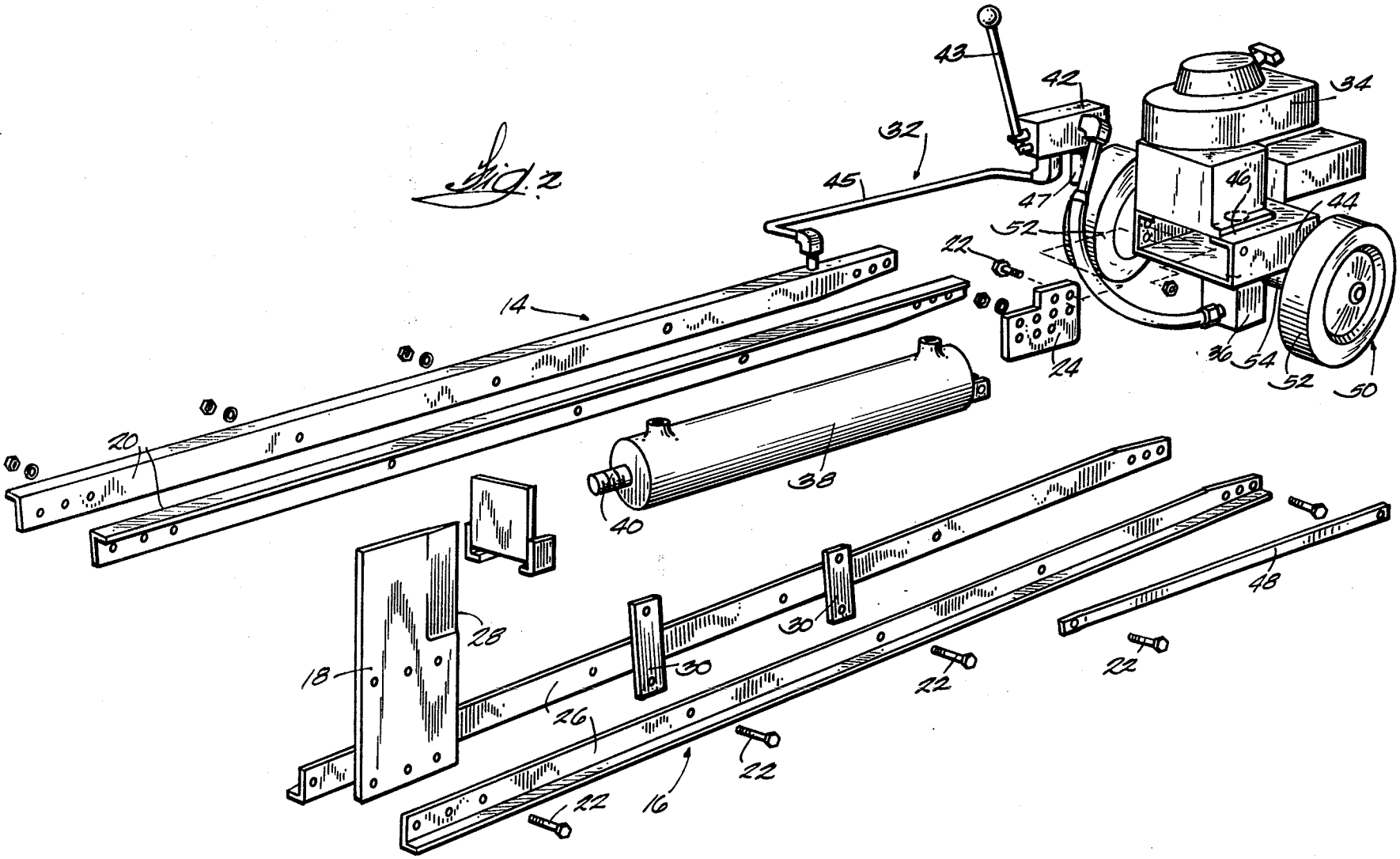
FIG. 2 is an exploded view of the components of the log splitter.

As mentioned above, the first end of the elongated horizontal member 14 is fixedly attached to the first end of the elongated second member 16 by a backplate 24, shown in FIG. 2. The backplate 24 is generally flat and lies in the common vertical plane of the elongated horizontal member 14 and the elongated second member 16. The backplate 24 is bolted between the elongated angle members 20 of the elongated horizontal member 14 and the elongated angle members 26 of the elongated second member 16, as shown in FIGS. 1 and 2.

The frame 12 of the log splitter 10 further includes brace members 30 horizontally spaced intermediate the first and second ends of the elongated horizontal member 14 and extending vertically to connect the elongated horizontal member 14 to the elongated second member 16. Each brace member 30 has upper and lower ends, the upper end being bolted between the elongated angle members 20 of the elongated horizontal member 14, and the lower end being bolted between the elongated angle members 26 of the elongated second member 16.

With the wedge member 18 being bolted between the elongated angle members 20 and 26 at the second ends of the elongated horizontal and second members 14 and 16, the back plate 24 being bolted between the elongated angle members 20 and 26 at the first ends of the elongated horizontal and second members 14 and 16, and the brace members 30 being bolted between the elongated angle members 20 and 26 intermediate the ends of the elongated horizontal and second members 14 and 16, the elongated angle members 20 and 26 of the elongated horizontal and second members 14 and 16 are fixedly attached to and spaced apart from each other. The spacing is provided by the wedge member 18, the back plate 24, and the brace members 30.

This frame construction provides a strong log splitter 10 which is less expensive, and more portable, than known log splitters. The elongated angle members 20 and 26 are lighter and less expensive than commonly used I-beams. Having the wedge member 18 connected to both the elongated horizontal member 14 and the elongated second member 16 prevents bending of the elongated horizontal member 14, because the elongated second member 16 counteracts the force exerted on the wedge member 18 by the log 11 during operation, thereby reducing the bending moment imparted on the elongated horizontal member 14.

This frame construction also provides a log splitter 10 which is easy to maintain. The wedge 18 is easy to replace because it is removably bolted between the elongated angle members 20 of the elongated horizontal member 14 and the elongated angle members 26 of the elongated second member 16. Similarly, the other components of the frame 12 are easy to replace.

The log splitter 10 also includes ram means 32 for pushing a log 11 toward the splitting edge 28 of the wedge member 18 for splitting the log 11 with the wedge member 18. In this embodiment, the ram means 32 comprises an internal combustion engine 34 operably connected to a hydraulic pump 36, a hydraulic cylinder 38 and piston 40, and valve means 42 connecting the hydraulic pump 36 to the hydraulic cylinder 38 for selectively and alternatively moving the piston 40 inwardly and outwardly of the cylinder 38. The valve means 42 comprises a conventional hydraulic control valve adapted to be manually operated by a control handle 43 and is connected to opposite ends of the hydraulic cylinder by fluid lines 45 and 47. These ram means 32 are conventional in the art and their operation will not be described in further detail.

In the illustrated embodiment, the hydraulic cylinder 38 and valve means 42 are mounted on the upper surface of the elongated horizontal member 14 such that the piston 40 can push a log 11 toward the splitting edge 28 of the wedge member 18. The engine 34 and the pump 36 are mounted on an engine channel 44, as best shown in FIG. 2. The engine channel 44 is a piece of channel iron having a rectangular cross section, with the walls having greater width being disposed horizontally. The engine 34 is mounted on top of the engine channel 44, the pump 36 is mounted below the engine channel 44, and a drive shaft 46 (shown in FIG. 2) extends downwardly through the engine channel 44 operably connecting the engine 34 to the pump 36. The engine channel 44 is bolted to the backplate 24, as also shown in FIG. 2. It should be understood that in alternative embodiments these ram means 32 could be attached to the frame 12 in other ways consistent with the claimed invention.

In this embodiment, the log splitter 10 also includes a horizontal brace member 48 connecting the engine channel 44 to the elongated second member 16. The horizontal brace member 48 is bolted to the engine channel 44 and to the elongated second member 16 (as shown in FIG. 1), providing additional stability.

The log splitter 10 also includes means 50 supporting the second end of the elongated horizontal member 14 and the second end of the elongated second member 16 above the supporting surface. While various suitable means could be employed for this purpose, in the construction illustrated, the supporting means 50 includes a pair of wheels 52 mounted on opposite ends of an axle 54, the axle 54 being rotatably connected to the engine channel 44, as shown in FIG. 2. The wheels 52 add to the portability of the log splitter 10.

Various features of the invention are set forth in the following claims.

We claim:

1. A log splitter comprising a frame generally in the shape of a right triangle, said frame including an elongated horizontal member forming a first leg of said right triangle, said elongated horizontal member having a longitudinal axis and including a first end, a second end, and an upper surface adapted to support a log, an elongated second member forming a hypotenuse of said right triangle and being positioned below said elongated horizontal member, said elongated second member including a first end and a second end, said first end of said elongated second member being fixedly attached to said first end of said elongated horizontal member, said second end of said elongated second member being spaced below said second end of said elongated horizontal member such that said elongated second member and said elongated horizontal member form an acute angle, and said second end of said elongated second member being adapted to rest on a supporting surface, and a wedge member including upper and lower portions, said upper portion of said wedge member extending upwardly from said second end of said elongated horizontal member and having a splitting edge, said splitting edge being generally perpendicular to the longitudinal axis of said elongated horizontal member and facing said first end of said elongated horizontal member, and said lower portion of said wedge member forming a third leg of said right triangle and being secured to said second end of said elongated horizontal member and to said second end of said elongated second member and supporting said second ends in rigidly spaced apart relation, and ram means for pushing a log along said upper surface of said elongated horizontal member toward said splitting edge of said wedge member for splitting the log with said wedge member.

2. A log splitter in accordance with claim 1 wherein said elongated horizontal member comprises a pair of elongated members bolted together, wherein said elongated second member comprises a pair of elongated members bolted together, and wherein said lower portion of said wedge member is positioned between and bolted to said elongated members comprising said elongated horizontal member and said elongated second member.

3. A log splitter in accordance with claim 1 wherein said wedge member comprises a plate including a vertical edge, said vertical edge having an upper portion forming said splitting edge of said wedge member.

4. A log splitter in accordance with claim 1 wherein said wedge member is removably secured to said second ends of said elongated horizontal member and said elongated second member.

5. A log splitter in accordance with claim 1 wherein said frame further includes a plurality of brace members, said brace members being horizontally spaced apart intermediate said first and second ends of said elongated horizontal member, each of said brace members extending vertically to connect said elongated horizontal member to said elongated second member.

6. A log splitter in accordance with claim 1 wherein said ram means includes an internal combustion engine operably connected to a hydraulic pump, a hydraulic cylinder and piston, said hydraulic cylinder being mounted on said upper surface of said elongated horizontal member such that said piston can push a log toward said splitting edge, and valve means connecting said pump to said cylinder for selectively and alternatively moving said piston inwardly and outwardly of said cylinder.

7. A log splitter comprising a frame including an elongated horizontal member having a longitudinal axis, said elongated horizontal member having first and second ends and including a pair of elongated angle members, said elongated angle members each comprising first and second elongated flat portions with said first elongated flat portion having a lateral edge integrally joined to a lateral edge of said second elongated flat portion, said elongated angle members being fixedly attached to and spaced apart from each other such that said first elongated flat portions are spaced apart in back-to-back relation and said second elongated flat portions extend in opposite directions from said back-to-back first elongated flat portions and lie in a common plane, said second elongated flat portions forming a generally flat upper surface, said generally flat upper surface of said elongated horizontal member facing upwardly and being adapted to support a log, an elongated second member positioned below said elongated horizontal member in the vertical plane of said elongated horizontal member, said elongated second member having first and second ends, said first end of said elongated second member being fixedly connected to said first end of said elongated horizontal member, said second end of said elongated second member being spaced below said second end of said elongated horizontal member such that said elongated second member and said elongated horizontal member form an acute angle, and said second end of said elongated second member being adapted to rest on a supporting surface, and a wedge member extending vertically in the common plane of said elongated horizontal member and said elongated second member, said wedge member including a splitting edge extending upwardly from said elongated horizontal member and generally perpendicular to the longitudinal axis of said elongated horizontal member, said splitting edge facing said first end of said elongated horizontal member, means for supporting said first end of said elongated horizontal member and said first end of said elongated second member above the supporting surface, and ram means for pushing a log along said upper surface of said elongated horizontal member toward said splitting edge of said wedge member for splitting the log with said wedge member.

8. A log splitter in accordance with claim 7 wherein said wedge member includes upper and lower portions, said upper portion of said wedge member extending upwardly from said second end of said elongated horizontal member and including said splitting edge, and said lower portion of said wedge member being secured to said second end of said elongated horizontal member and to said second end of said elongated second member and supporting said second ends in rigidly spaced apart relation.

9. A log splitter in accordance with claim 8 wherein said elongated second member includes a pair of elongated angle members, said elongated angle members each comprising first and second elongated flat portions, with said first elongated flat portion having a lateral edge integrally joined to a lateral edge of said second elongated flat portion, said elongated angle members being fixedly attached to and spaced apart from each other such that said first elongated flat portions are spaced apart in back-to-back relation and said second elongated flat portions extend in opposite directions from said back-to-back first elongated flat portions and lie in a common plane, said second elongated flat portions forming a generally flat surface, said generally flat surface facing generally downward.

10. A log splitter in accordance with claim 9 wherein said lower portion of said wedge member is removably bolted between said spaced apart first elongated flat portions of said elongated horizontal member, and is removably bolted between said spaced apart first elongated flat portions of said elongated second member.

11. A log splitter in accordance with claim 7 wherein said elongated angle members of said elongated horizontal member are releasably attached to each other in spaced apart back-to-back relation.

12. A log splitter in accordance with claim 7 wherein said frame further includes a plurality of generally flat brace members, said brace members being horizontally spaced apart intermediate said first and second ends of said elongated horizontal member, each of said brace members extending vertically to connect said elongated horizontal member to said elongated second member.

13. A log splitter in accordance with claim 12 wherein each of said generally flat brace members has a first end and a second end, said first end being bolted between said spaced apart first elongated flat portions of said elongated horizontal member, and said second end being bolted between said spaced apart first elongated flat portions of said elongated second member.

14. A log splitter in accordance with claim 7 wherein said frame further includes a generally flat connecting member connecting said first end of said elongated horizontal member to said first end of said elongated second member, said connecting member having upper and lower ends, said upper end being bolted between said spaced apart first elongated flat portions of said elongated horizontal member, and said lower end being bolted between said spaced apart first elongated flat portions of said elongated second member.

15. A log splitter in accordance with claim 7 wherein said ram means includes an internal combustion engine operably connected to a hydraulic pump, a hydraulic cylinder and piston, said hydraulic cylinder being mounted on said generally flat surface of said elongated horizontal member such that said piston can push a log toward said splitting edge, and valve means connecting said pump to said cylinder for selectively and alternatively moving said piston inwardly and outwardly of said cylinder.

16. A log splitter comprising a frame including an elongated horizontal member having a longitudinal axis, said elongated horizontal member having first and second ends and including a pair of elongated angle members fixedly attached to each other in spaced apart parallel back-to-back relation and being adapted to support a log, an elongated second member positioned below said elongated horizontal member in the vertical plane of said elongated horizontal member, said elongated second member having first and second ends, said first end of said elongated second member being fixedly connected to said first end of said elongated horizontal member, said second end of said elongated second member being spaced below said second end of said elongated horizontal member such that said elongated second member and said elongated horizontal member form an acute angle, and said second end of said elongated member being adapted to rest on a supporting surface, and a wedge member extending vertically in the common plane of said elongated horizontal member and said elongated second member, said wedge member including a splitting edge extending upwardly from said elongated horizontal member and generally perpendicular to the longitudinal axis of said elongated horizontal member, said splitting edge facing said first end of said elongated horizontal member, and ram means for pushing a log along said upper surface of said elongated horizontal member toward said splitting edge of said wedge member for splitting the log with said wedge member.

17. A log splitter in accordance with claim 16 wherein said wedge member includes upper and lower portions, said upper portion of said wedge member extending upwardly from said second end of said elongated horizontal member and including said splitting edge, and said lower portion of said wedge member being secured to said second end of said elongated horizontal member and to said second end of said elongated second member and supporting said second ends in rigidly spaced apart relation.

18. A log splitter in accordance with claim 17 wherein said elongated second member includes a pair of elongated angle members fixedly attached to each other in spaced apart parallel back-to-back relation.

19. A log splitter in accordance with claim 18 wherein said lower portion of said wedge member is removably bolted between said spaced apart elongated angle members of said elongated horizontal member, and is removably bolted between said spaced apart elongated angle members of said elongated second member.

20. A log splitter in accordance with claim 16 wherein said elongated angle members of said elongated horizontal member are releasably attached to each other in spaced apart back-to-back relation.

21. A log splitter in accordance with claim 16 wherein said frame further includes a plurality of generally flat brace members, said brace members being horizontally spaced apart intermediate said first and second ends of said elongated horizontal member, each of said brace members extending vertically to connect said elongated horizontal member to said elongated second member.

22. A log splitter in accordance with claim 21 wherein each of said generally flat brace members has a first end and asecond end, said first end being bolted between said spaced apart elongated angle members of said elongated horizontal member, and said second end being bolted between said spaced apart elongated angle members of said elongated second member.

23. A log splitter in accordance with claim 16 wherein said frame further includes a generally flat connecting member connecting said first end of said elongated horizontal member to said first end of said elongated second member, said connecting member having upper and lower ends, said upper end being bolted between said spaced apart elongated angle members of said elongated horizontal member, and said lower end being bolted between said spaced apart elongated angle members of said elongated second member.

24. A log splitter in accordance with claim 16 wherein said ram means includes an internal combustion engine operably connected to a hydraulic pump, a hydraulic cylinder and piston, said hydraulic cylinder being mounted on said elongated horizontal member such that said piston can push a log toward said splitting edge, and valve means connecting said pump to said cylinder for selectively and alternatively moving said piston inwardly and outwardly of said cylinder.

* * * * *